US005532720A

United States Patent [19]

Krueger et al.

[11] Patent Number: 5,532,720

[45] Date of Patent: Jul. 2, 1996

[54] SOLVENT RECOVERY SYSTEM FOR INK JET PRINTER

[75] Inventors: William J. Krueger, Saratoga Spring; Victor G. Eckstein, Galway, both of N.Y.

[73] Assignee: Quad/Tech, Inc., Sussex, Wis.

[21] Appl. No.: 121,930

[22] Filed: Sep. 15, 1993

[51] Int. Cl.[6] ..... B41J 2/18

[52] U.S. Cl. ..... 347/7; 347/895; 347/89

[58] Field of Search ..... 347/6, 7, 89, 85; 367/17

[56] References Cited

U.S. PATENT DOCUMENTS

| | | | |
|---|---|---|---|
| 3,891,121 | 6/1975 | Stoneburner | 347/89 |
| 3,929,071 | 12/1975 | Cialone et al. | 101/335 |
| 4,013,004 | 3/1977 | Watanabe et al. | 101/1 |
| 4,067,020 | 1/1978 | Arway | 347/7 |
| 4,121,222 | 10/1978 | Diebold et al. | 347/7 |
| 4,246,839 | 1/1981 | Willbanks | 101/1 |
| 4,360,817 | 11/1982 | Arway et al. | 346/75 |
| 4,361,845 | 11/1982 | Smith | 346/140 |
| 4,751,528 | 6/1988 | Spehrley, Jr. et al. | 346/140 |
| 4,862,192 | 8/1989 | Slomianny | 347/7 |
| 4,864,323 | 9/1989 | Lecheheb et al. | 346/1.1 |
| 4,952,947 | 8/1990 | Kyoshima | 346/140 |
| 4,999,643 | 4/1991 | Terasawa | 346/1.1 |
| 5,335,000 | 8/1994 | Stevens | 347/89 |

FOREIGN PATENT DOCUMENTS

| | | | |
|---|---|---|---|
| 247167 | 10/1989 | Japan . | |
| 91/17052 | 11/1991 | WIPO | 347/6 |
| 93/17869 | 9/1993 | WIPO | 347/7 |

OTHER PUBLICATIONS

Driscoll et al, "Evaporation Recovery System", IBM Tech Disclosure, vol. 25, No. 3A, Aug. 82, pp. 946–947.

*Primary Examiner*—N. Le
*Attorney, Agent, or Firm*—Michael, Best & Friedrich

[57] ABSTRACT

An ink supply system for ink jet printers, the ink supply system including a closed ink supply tank for containing ink and solvent, a condenser to cool air from a tube, and a tube having connected to the air space of the ink supply tank and the condenser such that air containing evaporated solvent from the tube is cooled by the condenser such that solvent in the air will condense. Preferably, the condenser is positioned above the ink supply tank so that condensed solvent drains into the ink supply tank. Preferably, a solvent make up container is connected to the ink supply tank for supplying solvent to the ink supply tank, and an equalizing conduit connects the solvent make up container airspace to one of the ink supply tank airspace and the tube to provide for equalization of the fluid pressure between the solvent make up container and the ink supply tank. Preferably, a solvent supply device supplies solvent to the solvent make up container. The solvent supply device includes a solvent supply container for containing solvent, a support device for supporting the solvent supply container and a conduit connecting the solvent supply container to the solvent make up container such that solvent can be supplied to the solvent make up container from the solvent supply container without venting the solvent make up container to the atmosphere. Also, a solvent recovery system for recovery of solvent contained in solvent containing liquids.

40 Claims, 3 Drawing Sheets

SOLVENT RECOVERY SYSTEM FOR INK JET PRINTER

FIELD OF THE INVENTION

The invention relates to ink jet printers and more particularly to a solvent recovery system for controlling discharge of solvent vapors from an ink jet printer and for recovery of solvent vapors for reintroduction of solvent into the ink of the ink jet printer.

BACKGROUND OF THE INVENTION

Ink jet printing is utilized in a variety of printing applications and is particularly useful in the assembly of magazines where customized or personalized messages, such as address labels, need to be printed without smearing. Ink jet printing devices of the continuous stream type commonly employ a print head having a droplet generator with multiple nozzles from which continuous streams of ink are emitted under pressure. The droplets of ink are charged and deflected by an electromagnetic field into a gutter for ink collection or alternatively to a specific target location such as onto paper which may be continuously transported at a relatively high speed across the paths of the droplets. Ink is delivered to the ink jet printing heads from an ink supply tank, The ink which is deflected by the electromagnetic field into the gutter is drawn by a vacuum pump through a vacuum line back into the ink supply tank. The ink returning to the ink supply tank is entrained in air which is vented from the ink supply tank.

The ink used in an ink jet printer commonly includes a highly volatile solvent such as methyl ethyl ketone (MEK). The air vented from a conventional ink supply tank includes significant amounts of solvent vapors, and such prior art ink jet printers discharge substantial amounts of solvent into the atmosphere. Such solvents are expensive materials in the printing process, and evaporation losses comprise a significant amount of the solvent used in an ink jet printing process. Discharge of solvents into the atmosphere is also harmful to air quality.

In some prior art ink jet printers, the air vented from the ink supply tank is passed through a room temperature container wherein solvent vapors can condense and can be returned to the ink supply tank. Such systems are effective to return only a small quantity of solvent to the ink supply tank, and a substantial quantity of solvent is vented as vapor to the atmosphere.

Since solvent and ink are in the printing process, the ink supply tank must be refilled. Although the level of ink in the ink supply tank can be monitored by periodic visual inspections, the ink supply tank typically includes a level indicator for monitoring the level of ink. Additionally, the ink must be maintained within a specific viscosity range in order to provide satisfactory printing results. Therefore, the viscosity of ink supplied from the ink supply tank to the print head typically is monitored with a viscosity meter. To prevent the tank from running empty and to maintain the ink viscosity within a desired range, separate ink and solvent make up containers are typically utilized. The ink and solvent make up containers are connected to the ink supply tank by respective conduits, and each conduit includes a respective control valve. Each of the respective ink and solvent control valves is moveable between a closed position and an open position wherein ink or solvent, respectively, flows from the respective make up container and into the ink supply tank.

If the ink in the ink supply tank falls below a predetermined level, a control system connected to the level indicator causes the ink control valve to open so that ink flows from the ink make up container into the ink supply tank to replenish the ink supply. If the viscosity of the ink rises above a predetermined level, the control system connected to the viscosity meter causes the solvent control valve to open so that solvent flows from the solvent make up container into the ink supply tank to decrease the viscosity of the ink.

Commonly, the levels of ink and solvent in the make up containers are monitored to ensure that the make up containers do not run empty. Although they may be monitored by periodic visual inspection, the make up containers typically include level indicators connected to indicator lights. The level indicators typically include one or more sensors extending through the top and walls of the make up containers. The make up containers typically also include tops which are removable for ink or solvent to be manually poured into the respective container. When the top of the solvent make up container is opened for filling the container, significant amounts of solvent are vented from the container to the atmosphere. The level indicator sensors can also be damaged when the tops are repeatedly removed and replaced.

SUMMARY OF THE INVENTION

The invention provides a closed loop ink supply system for an ink jet printer wherein ink and solvent supply containers are closed to the atmosphere to prevent the escape of solvent to the atmosphere. More particularly, the ink supply system includes a closed ink supply tank wherein vapors discharged from the tank are vented through a vent tube connected to a condenser provided for cooling the vapor in the tube sufficiently that substantially all the solvent vapor in the vented air will condense. The condenser is positioned above the ink supply tank such that any condensed solvent will draw or return through the vent tube to the ink supply tank. Substantially all solvent entrained in air vented through the tube is recovered.

The ink supply system further includes respective ink and solvent make up containers connected to the ink supply tank through control valves to deliver ink and solvent to the tank. The ink and solvent make up containers are closed to the atmosphere and are connected to either the ink supply tank airspace or the lower end of the vent tube through a conduit such that the make up tanks are maintained at the same pressure as the pressure in the airspace of the tank to thereby facilitate gravity flow of make up ink and solvent to the supply tank.

The ink supply system further includes ink and solvent supply devices which facilitate adding ink and solvents to the make up containers without opening the make up containers to the atmosphere. More specifically, each of the ink and solvent supply devices includes a respective supply container for containing ink or solvent, a support device for supporting the respective supply container and a conduit connecting the supply container to the make up container such that ink or solvent, respectively, is supplied to the respective make up container without venting the make up container to the atmosphere. The support device further includes a second conduit connecting the airspaces of the supply and make up containers to vent the make up container airspaces to the supply containers. Preferably, the support device supports the respective supply container for tipping movement between upright and inverted positions.

DETAILED DESCRIPTION OF A PREFERRED EMBODIMENT

Shown in the various figures is a liquid supply system 10 for supplying liquid containing a volatile component to a suitably adapted apparatus. While it should be understood that the liquid supply system 10 can be used to supply liquid containing a volatile component to any suitably adapted apparatus, the liquid supply system 10 shown in the figures is particularly well suited for supplying ink to an ink jet printer and will be described in connection with that application.

Figure 1:
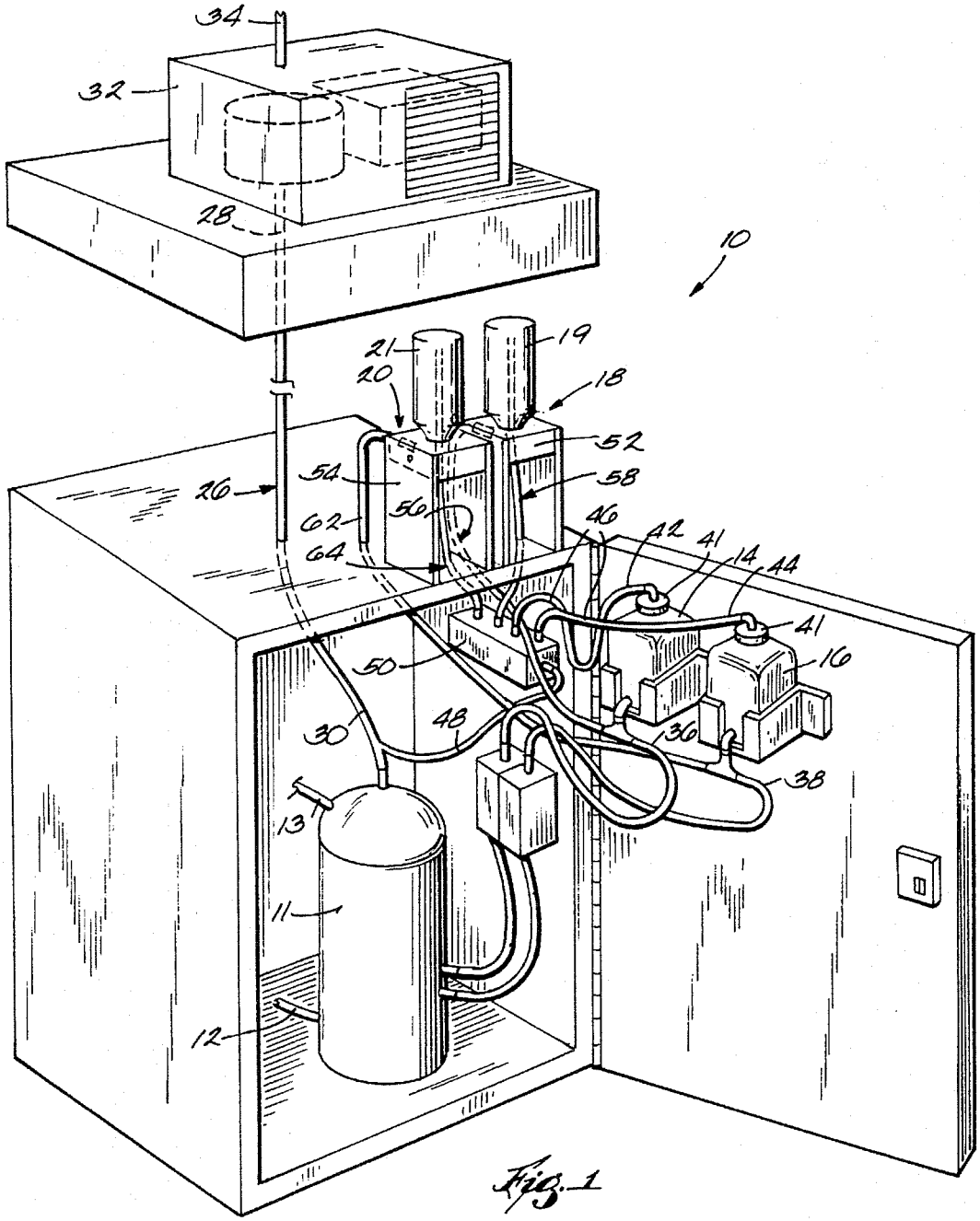
FIG. 1 is a perspective view of a liquid supply system of the invention.
Figure 2:
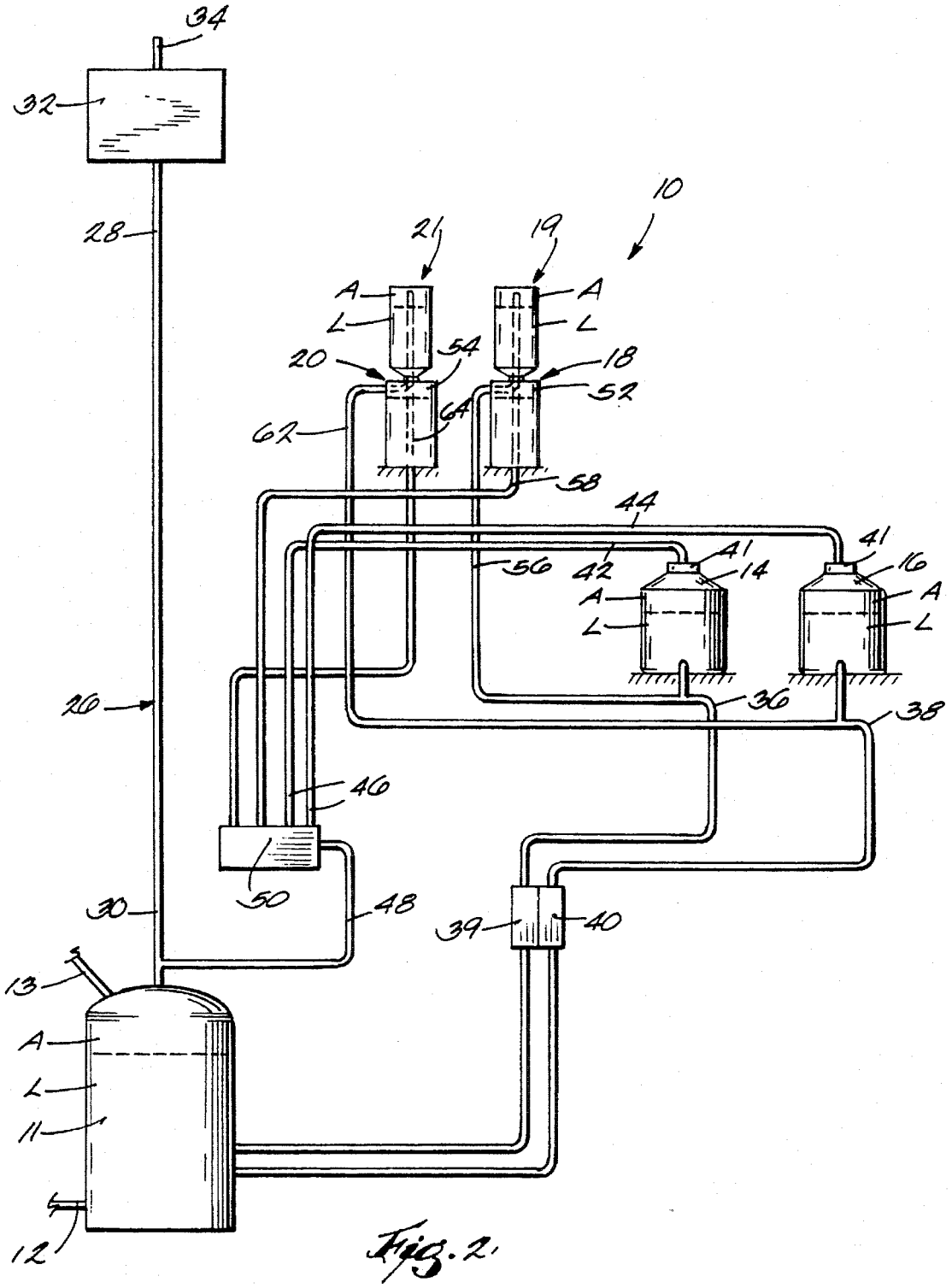
FIG. 2 is a schematic drawing of the liquid supply system shown generally in FIG. 1.
Figure 3:
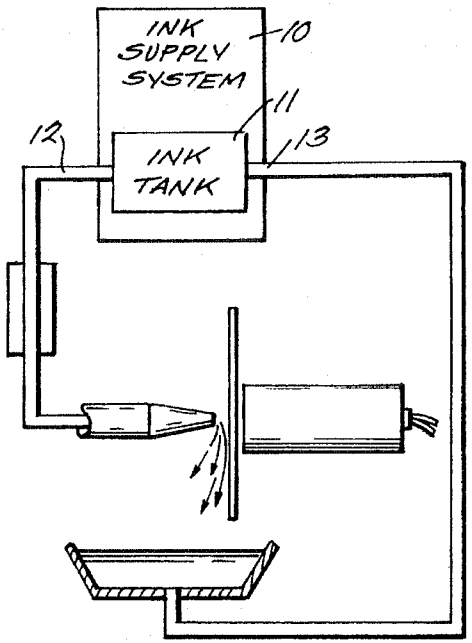
FIG. 3 is a schematic drawing of an ink jet printer including the liquid supply system shown in FIG. 2.

An ink jet printer connected to an ink supply system 10 is shown schematically in FIG. 3. The ink jet printer includes an ink supply conduit, ink charging device, a print head including a nozzle, an ink attracting device, an ink gutter and an ink return conduit. The ink jet printer may also include various conventional filters (not shown) for filtering the ink, and conventional pumps (not shown), such as vacuum pumps, for moving the ink through the various conduits. As shown in FIGS. 1 and 2, the ink supply system 10 for supplying liquid ink, including a volatile solvent, to the ink jet printer includes an ink supply tank 11, ink supply conduit 12, ink return conduit 13, ink make up container 14, solvent make up container 16, ink supply device 18 including ink supply container 19 and solvent supply device 20 including solvent supply container 21. The system 10 is configured as a "closed loop" to minimize the escape of the volatile solvent, such as methyl ethyl ketone, to the atmosphere. As used herein, "closed loop" means that the tank and containers are closed to the atmosphere to prevent or minimize the escape of solvent to the atmosphere.

The ink supply tank 11 is closed to the atmosphere and includes a liquid region L and airspace A. The ink supply tank 11 is connected to the ink jet printer by the ink supply conduit 12 to supply ink to the printer and the ink return conduit 13 to return ink from the printer. When returned to the ink supply tank 11, the ink includes air. Air entering the ink supply tank 11 through the ink return conduit 13 escapes the liquid region L and enters the airspace A. Solvent which evaporates or otherwise leaves the liquid region L also enters the airspace A.

Air and solvent vapors are discharged from the airspace A through a vent tube 26. Although the vent tube 26 may be omitted altogether or configured differently, in the illustrated embodiment of the invention the vent tube 26 is an elongated tubular member having opposed upper and lower end portions 28,30. The lower end portion 30 is sealingly connected to the ink supply tank 11. The upper end portion 28 is connected to a condenser 32. The condenser 32 includes a low temperature cooler for cooling the air and solvent vapor from the tube 26 sufficiently that substantially all the solvent vapor in the vented air will condense. Although the condenser 32 could be positioned differently, in the illustrated embodiment of the invention the condenser 32 is positioned above the ink supply tank 11 such that any such condensed solvent will return through the vent tube 26 to the ink supply tank 11. Substantially all solvent entrained in air vented through the tube 26 is recovered. The condenser 32 also includes a vent 34 for venting cooled air to the atmosphere. Preferably, the condenser 32 is an electrically powered condenser located on the roof of the building housing the ink jet printer and the remainder of the ink supply system 10, so that heat and noise caused by its operation dissipate into the atmosphere. More preferably, the condenser 32 is a Model DX 0020 VR condenser manufactured by Technical Equipment Fabricators Inc., West Milford, N.J.

The ink make up container 14 and solvent make up container 16 are connected to the ink supply tank through respective ink and solvent conduits 36,38 to deliver ink and solvent to the tank 11. Each of the respective ink and solvent conduits 36,38 includes a respective control valve 39,40 for controlling the flow of ink or solvent from the respective make up container 14,16 into the ink supply tank 11. Each of the control valves 39,40 is moveable between a closed position and an open position wherein ink or solvent respectively can flow into the ink supply tank 11. The movement of the control valves 39,40 is controlled by the control system (not shown) to which each is connected. The control system includes a level indicator (not shown) in the ink supply tank 11 for indicating the level of ink in the ink supply tank 11, a viscosity meter (not shown) for indicating the viscosity of the ink supplied from the ink supply tank 11, and one or more control circuits (not shown) for operating the control valves 39,40.

When the ink level in the ink supply tank 11 falls below a predetermined level, the control system causes the ink control valve 39 to open so that ink flows from the ink make up container 14 into the ink supply tank 11 to replenish the ink supply. If the viscosity of the ink rises above a predetermined level, the control system causes the solvent control valve 40 to open so that solvent flows from the solvent make up container 16 into the ink supply tank 11 to decrease the viscosity of the ink.

Each of the ink and solvent make up containers 14,16 includes a respective liquid region L and airspace A, and is closed to the atmosphere by a top 41. The airspaces A of the ink and solvent make up containers 14,16 are connected by respective ink and solvent pressure equalizing conduits 42,44 to the lower end portion 30 of the vent tube 26. In an alternate embodiment of the invention, the pressure equalizing conduits 42,44 can be connected to the airspace A of the ink supply tank 11. The respective conduits 42,44 equalize the pressure between the ink supply tank 11 and the ink and solvent make up containers 14,16 to thereby facilitate flow of ink and solvent from the respective make up containers 14,16 to the ink supply tank 11. Although the make up containers 14,16 can be positioned differently, in the illustrated embodiment of the invention the make up containers 14,16 are positioned generally above the ink supply tank 11, so that ink and solvent flow by gravity into the ink supply tank 11. Although the conduits 42,44 can be configured differently, in the illustrated embodiment of the invention each of the conduits 42,44 includes first and second portions 46,48 and a manifold 50. The first portion 46 is connected from the respective makeup container 14,16 to the manifold 50. The second portion 48 extends from the manifold 50 to the tube 26. In the illustrated embodiment of the invention, the second portion 48 is a single conduit common for both the ink and solvent make up containers 14,16, and the manifold 50 connects the first portion 46 of both conduits 42,44 to the single second portion 48.

Although the ink and solvent make up containers 14,16 can be constructed differently, in the illustrated embodiment of the invention each includes a level indicator (not shown) connected to an indicator light (not shown)to indicate if the level of ink or solvent falls below a predetermined level. The ink and solvent supply devices 18,20 include respective ink and solvent support devices 52,54 and ink and solvent supply containers 19,21 to supply ink and solvent respectively to the ink and solvent make up containers 14,16. Each of the ink and solvent supply containers 19,21 includes a respective liquid region L and airspace A. Although the ink and solvent supply containers 19,21 can be constructed differently, in the illustrated embodiment of the invention each is a removable plastic bottle including a bottom and an open neck having external male threads. When full, a supply container 19,21 is connected to a respective support device 52,54 as described in detail below, to supply its contents to a respective make up container 14,16, and is removed and replaced when empty.

The ink and solvent supply devices 18,20 include respective support devices 52,54, for supporting the ink and solvent supply containers 19,21 and first conduits 56,62 and second conduits 58,64 connecting the respective ink and solvent supply containers 19,21 to the respective ink and solvent make up containers 14,16. The ink and solvent supply containers 19,21 are supported by the respective support devices 52,54 such that ink and solvent are supplied to the respective ink and solvent make up containers 14,16 without solvent vapors being vented from the ink and solvent make up containers 14,16 to the atmosphere. A small amount of solvent vapor may be vented from the make up containers 14,16 and supply containers 19,21 to the atmosphere when the supply containers 19,21 are removed for replacement, but solvent vapor is not vented from the make up containers 14,16 to the atmosphere when the supply containers 19,21 are connected to the and support devices 52,54. Although the ink and solvent supply devices 18,20 can be positioned differently, in the illustrated embodiment of the invention the supply devices 18,20 are positioned generally above the make up containers 14,16, so that ink and solvent flow by gravity into the make up containers 14,16.

The supply devices 18,20 for supporting the respective ink and solvent supply containers 19,21 are substantially identical and will be described in connection with the ink supply device 18. Although the supply device 18 can be constructed differently, in the illustrated embodiment of the invention the ink supply device 18 includes a support device 52 connected to the first conduit 56 for connecting the ink supply container 19 to the ink make up container 14 to deliver ink from the ink supply container 19 to the ink make up container 14. The support device 52 is also connected to the second conduit 58 for connecting the airspace A of the ink make up container 14 to the airspace A of the ink supply container 19 to vent the airspace A of the ink make up container 14 to the ink supply container 19. Although other connections of the second conduit 58 are possible, in the illustrated embodiment of the invention the second conduit 58 is connected to the airspace A of the ink make up container 14 at the manifold 50.

Figure 4:
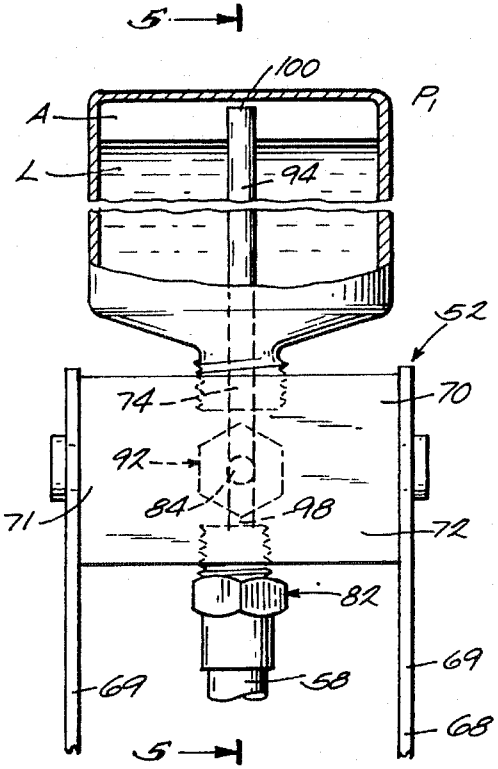
FIG. 4 is an enlarged view taken generally along line 4—4 in FIG. 1, showing an ink supply device.
Figure 5:
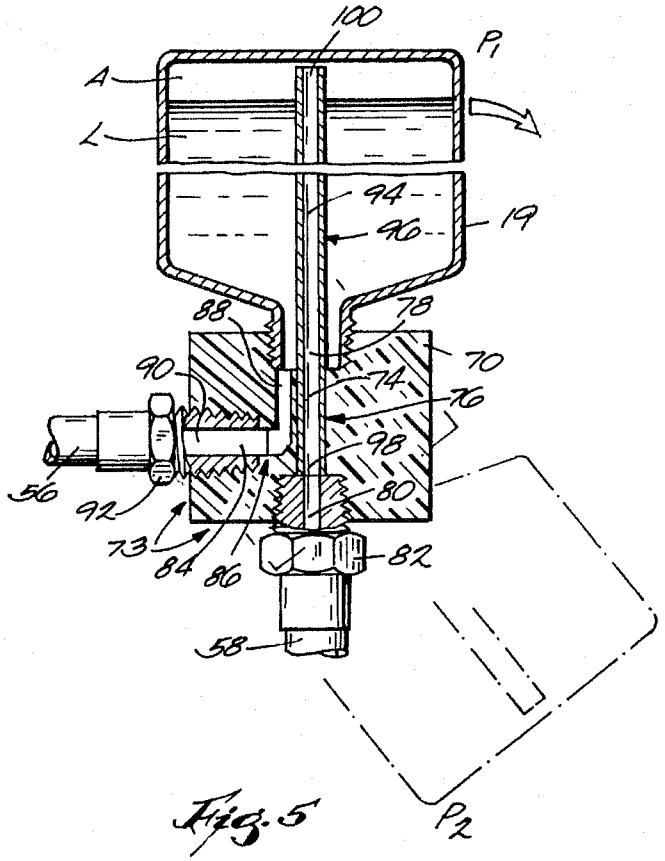
FIG. 5 is a partial sectional view taken generally along line 5—5 in FIG. 4.

The support devices 52,54 for supporting the respective ink and solvent supply containers 19,21 are substantially identical and will be described in connection with the support 52 for supporting the ink supply container 19. Referring to FIGS. 4 and 5, while other configurations of the support 52 are possible, in the illustrated embodiment of the invention the support 52 includes a generally U-shaped bracket 68 and a block 70. The U-shaped bracket 68 includes a pair of parallel vertically extending legs 69, and the block 70 extends horizontally between the parallel legs 69. The block 70 includes opposed end portions 71,72 mounted on the respective legs 69 for pivotal movement about a horizontally extending longitudinal axis between a first position $P_1$ and a second position $P_2$. The support 52 supports the ink supply container 19 for tipping movement from a first position $P_1$ where the ink supply container 19 is substantially upright to a second position $P_2$ where the ink supply container 19 is substantially inverted, and wherein in the second position $P_2$ the ink supply container 19 supplies ink through the first conduit 56 to the ink make up container 14 and the second conduit 58 vents the airspace A of the ink make up container 14 to the ink supply container 19.

The block 70 further includes a plurality of outer sides 73 and a radially extending primary aperture 74 having an inner wall 76 and opposed open upper and lower end portions 78,80. When the block occupies the first position $P_1$, the upper end portion 78 is generally above the lower end portion 80; however, when the block 70 is pivoted to position $P_2$, the relative positions of the upper and lower end portions 78,80 are reversed. The upper end portion 78 of the primary aperture 74 includes female threads for engaging the male threads on the neck of the ink supply container 19. In the lower end portion 80, the primary aperture 74 includes another set of female threads for engaging a threaded first connector 82. The first connector 82 connects the primary aperture 74 to the second conduit 58 for connecting the airspace A of the ink supply container 19 to the airspace A of the ink make up container 14 to vent the airspace A of the ink makeup container 14 to the ink supply container 19. The block 70 further includes secondary aperture 84 extending generally normal to the primary aperture 74. The secondary aperture 84 includes an inner wall 86 and opposed inner and outer end portions 88,90. The inner end portion 88 extends normal to the outer end portion 90 and generally parallel to the primary aperture 74, and connects to the lower end portion 80 of the primary aperture 74. The outer end portion 90 is open to an outer side 73 and includes female threads for engaging a second connector 92. The second connector 92 includes male threads for engaging the secondary aperture 84 and is also adapted to engage the first conduit 56 to supply ink from the ink supply container 19 to the ink make up container 14. The block 70 further includes a tubular member 94 having an outer wall 96 and open inner and outer end portions 98,100. The inner end portion 98 of the tubular member 94 communicates with the first connector 82 and extends from the first connector 82 through the primary aperture 74. The tubular member 94 extends through the upper end portion 78 of the primary aperture 74 and into the ink supply container 19. The outer end portion 100 of the tubular member 94 ends adjacent, but spaced slightly from, the bottom of the ink supply container 19. When the ink supply container 19 is tipped to position $P_2$, the outer end portion 100 of the tubular member 94 is located in the airspace A of the ink supply container 19, and the inner end portion 98 communicates with the first connector 82 and second conduit 58 to equalize pressure between the airspace A of the ink make up container 14 and the airspace A of the ink supply container 19, and thereby facilitate flow of the ink from the ink supply container 19 through the second connector 92 and first conduit 56 to the ink make up container 14.

In use, liquid ink including solvent is supplied to the ink jet printer from the ink supply tank 11 through the ink supply conduit 12, and unused ink is returned from the printer to the ink supply tank 11 through ink return conduit 13. Air and solvent leave the liquid region L and enter the airspace A of the ink supply tank 11. Because the ink supply tank 11 is closed to the atmosphere, the solvent vapors are not lost to the atmosphere.

Air and solvent vapors are discharged from the airspace A of the ink supply tank 11 through the vent tube 26. The air and solvent vapors pass from the tube 26 into the condenser 32, which cools the air and solvent vapor sufficiently that substantially all the solvent vapor in the vented air condenses, while cool air is vented to the atmosphere through the vent 34. Because the condenser 32 is positioned above the ink supply tank 11, the condensed solvent drains through the vent tube 26 to the ink supply tank 11. Substantially all the solvent vented through the tube 26 is recovered.

Ink and solvent are delivered to the ink supply tank 11 from the respective ink and solvent make up containers 14,16. The flow of ink and solvent through the respective ink and solvent conduits 36,38 is controlled by respective control valves 39,40 operating in response to the control system including the level indicator in the ink supply tank 11 and the viscosity meter in the ink supply conduit 12. Because the make up containers 14,16 are positioned above the ink supply tank 11, and the pressure between the make up containers 14,16 and ink supply tank 11 is equalized through the pressure equalizing conduits 42,44 connected to the lower end portion 30 of the vent tube 26, the ink and solvent flow by gravity from the respective make up containers 14,16 to the ink supply tank 11. Because the ink and solvent make up containers 14,16 are closed to the atmosphere, solvent is not lost to the atmosphere.

Ink and solvent are supplied to the ink and solvent make up containers 14,16 from respective ink and solvent supply devices 18,20. The ink and solvent supply devices 18,20 include respective ink and solvent supply containers 19,21, which in the illustrated embodiment of the invention are removable plastic bottles. A full bottle 19,21 of ink or solvent, respectively, is connected to the block 70 of the respective support device 52,54 in the upright first position $P_1$, and the block 70 is pivoted so that the bottle 19,21 is inverted in the second position $P_2$. The tubular member 94 ends in the airspace A, so that the pressure is equalized between the airspaces A of the respective make up containers 14,16 and supply containers 19,21. Because the supply containers 19,21 are positioned above the make up containers 14,16, and the pressure is equalized between the airspaces A, the ink and solvent flow by gravity from the supply containers 19,21 into the respective make up containers 14,16. Because the supply containers 19,21 are closed to the atmosphere when connected to the respective support devices 52,54, solvent vapor is not lost to the atmosphere.

We claim:

1. An ink supply system for ink jet printers, the ink supply system comprising an ink supply tank for containing ink and solvent, the tank being connectable to an ink jet printer, the tank being a closed container and including an airspace having evaporated solvent therein;

a condenser positioned above said ink supply tank and including a low temperature cooler;

a tube connected to the airspace of said ink supply tank and to the condenser such that air containing evaporated solvent from the airspace is cooled by the low temperature cooler of the condenser and such that solvent in the air will condense and the condensed solvent is caused to flow by gravity back into said ink supply tank;

a solvent make up container connected to the ink supply tank for supplying solvent to the ink supply tank, said solvent make up container including an airspace; and an equalizing conduit connecting the solvent make up container airspace to one of the ink supply tank airspace and the tube to provide for equalization of pressure between the solvent make up container and the ink supply tank.

2. An ink supply system as set forth in claim 1 and wherein said equalizing conduit includes first and second portions and a manifold, said conduit first portion connecting the solvent make up container airspace to the manifold and said conduit second portion connecting the manifold to the ink supply tank.

3. An ink supply system as set forth in claim 1 and wherein the solvent make up container is sealed such that solvent vapor in the container is not vented to the atmosphere.

4. An ink supply system as set forth in claim 3 and further including a solvent supply device for supplying solvent to the solvent make up container, said solvent supply device including a solvent supply container for containing solvent, said solvent supply container including an airspace, said solvent supply device including a supporting device for supporting said solvent supply container and a first conduit connecting the solvent supply container to the solvent make up container such that solvent can be supplied to the solvent make up container from the solvent supply container without venting the solvent make up container to the atmosphere.

5. An ink supply system as set forth in claim 4 and wherein said solvent supply device further includes a second conduit connecting the solvent make up container airspace to the solvent supply container airspace to vent the solvent make up container airspace to the solvent supply container, and the supporting device supports the solvent supply container for tipping movement from a first position where the solvent supply container is substantially upright and a second position where the solvent supply container is substantially inverted, wherein in the second position the solvent supply container supplies solvent through the first conduit to the solvent make up container and the second conduit vents the airspace of the solvent make up container to the solvent supply container.

6. An ink supply system as set forth in claim 1 and further including an ink make up container connected to the ink supply tank for supplying ink to the ink supply tank, said ink make up container including an airspace;

an equalizing conduit connecting the ink make up container airspace to one of the ink supply tank airspace and the tube to provide for equalization of pressure between the ink make up container and the ink supply tank.

7. An ink supply system as set forth in claim 6 and wherein said ink make up container is sealed such that solvent vapor in the container is not vented to the atmosphere.

8. An ink supply system as set forth in claim 6 and wherein the ink make up container is sealed such that solvent vapor in the container is not vented to the atmosphere.

9. An ink supply system as set forth in claim 8 and further including an ink supply device for supplying ink to the ink make up container, said ink supply device including an ink supply container for containing ink, said ink supply container including an airspace, said ink supply device including a supporting device for supporting said ink supply container and a first conduit connecting the ink supply container to the ink make up container such that ink can be supplied to the ink make up container from the ink supply container without venting the ink make up container to the atmosphere.

10. An ink supply system as set forth in claim 9 and wherein said ink supply device further includes.

a second conduit connecting the ink make up container airspace to the ink supply container airspace to vent the airspace of the ink make up container to the ink supply container, and the supporting device supports the ink supply container for tipping movement from a first position where the ink supply container is substantially upright and a second position where the ink supply container is substantially inverted, wherein in the second position the ink supply container supplies ink through the first conduit to the ink make up container and the second conduit vents the airspace of the ink make up container to the ink supply container.

11. An ink supply system for ink let printers, the ink supply system comprising an ink supply tank for containing ink and solvent, the tank being connectable to an ink let printer, the tank being a closed container and including an airspace having evaporated solvent therein; and a condenser connected to the airspace and positioned above the ink supply tank, the condenser including a low temperature cooler for receiving from the airspace and cooling air having therein evaporated solvent such that solvent in the air will condense and the condensed solvent is caused to flow by gravity from the condenser back into the ink supply tank;

a solvent make up container connected to the ink supply tank for supplying solvent to the ink supply tank, said solvent make up container having an airspace; and an equalizing conduit connecting the solvent make up container airspace to one of the ink supply tank airspace and the condenser to provide for equalization of pressure between the solvent make up container and the ink supply tank.

12. An ink supply system as set forth in claim 11 and wherein said equalizing conduit includes first and second portions and a manifold, said conduit first portion connecting the solvent make up container airspace to the manifold and said conduit second portion connecting the manifold to one of the ink supply tank and the condenser.

13. An ink supply system as set forth in claim 11 and wherein the solvent make up container is sealed such that solvent vapor in the container is not vented to the atmosphere.

14. An ink supply system as set forth in claim 13 and further including a solvent supply device for supplying solvent to the solvent make up container, said solvent supply device including a solvent supply container for containing solvent, said solvent supply container including an airspace, said solvent supply device including a supporting device for supporting said solvent supply container and a first conduit connecting the solvent supply container to the solvent make up container such that solvent can be supplied to the solvent make up container without venting the solvent make up container to the atmosphere.

15. An ink supply system as set forth in claim 14 and wherein said solvent supply device further includes a second conduit connecting the solvent make up container airspace to the solvent supply container airspace to vent the solvent make up container airspace to the solvent supply container, and the supporting device supports the solvent supply container for tipping movement from a first position where the solvent supply container is substantially upright and a second position where the solvent supply container is substantially inverted, wherein in the second position the solvent supply container supplies solvent through the conduit connecting the solvent supply container to the solvent make up container and the second conduit vents the airspace of the solvent make up container to the solvent supply container.

16. An ink supply system as set forth in claim 11 and further including a solvent make up container connected to the ink supply tank for supplying solvent to the ink supply tank, said solvent make up container having an airspace; and an equalizing conduit connecting the solvent make up container airspace to one of the ink supply tank airspace and the condenser to provide for equalization of pressure between the solvent make up container and the ink supply tank.

17. An ink supply system as set forth in claim 16 and wherein said equalizing conduit includes first and second portions and a manifold, said conduit first portion connecting the solvent make up container airspace to the manifold and said conduit second portion connecting the manifold to one of the ink supply tank and the condenser.

18. An ink supply system as set forth in claim 16 and further including a solvent make up container connected to the ink supply tank for supplying solvent to the ink supply tank, said solvent make up container having an airspace; and an equalizing conduit connecting the solvent make up container airspace to one of the ink supply tank airspace and the condenser to provide for equalization of pressure between the solvent make up container and the ink supply tank.

19. An ink supply system as set forth in claim 18 and further including a solvent supply device for supplying solvent to the solvent make up container, said solvent supply device including a solvent supply container for containing solvent, said solvent supply container including an airspace, said solvent supply device including a supporting device for supporting said solvent supply container and a first conduit connecting the solvent supply container to the solvent make up container such that solvent can be supplied to the solvent make up container without venting the solvent make up container to the atmosphere.

20. An ink supply system as set forth in claim 19 and wherein said solvent supply device further includes a second conduit connecting the solvent make up container airspace to the solvent supply container airspace to vent the solvent make up container airspace to the solvent supply container, and the supporting device supports the solvent supply container for tipping movement from a first position where the solvent supply container is substantially upright and a second position where the solvent supply container is substantially inverted, wherein in the second position the solvent supply container supplies solvent through the conduit connecting the solvent supply container to the solvent make up container and the second conduit vents the airspace of the solvent make up container to the solvent supply container.

21. A solvent recovery system for recovery of solvent contained in solvent containing liquids, said system comprising a liquid supply tank for containing the liquid and solvent, the tank being connectable to an apparatus using the liquid, the tank being a closed container and including an airspace having evaporated solvent therein;

a condenser positioned above said liquid supply tank and including a low temperature cooler;

a tube connected to the airspace of said liquid supply tank and the other of the opposite ends being connected to the condenser such that air containing evaporated solvent from the tube is cooled by the low temperature cooler of the condenser and such that solvent in the air will condense and the condensed solvent is caused to flow by gravity back into said ink supply tank;

a solvent make up container connected to the ink supply tank for supplying solvent to the ink supply tank, said solvent make up container having an airspace; and an equalizing conduit connecting the solvent make up container airspace to one of the ink supply tank airspace and the condenser to provide for equalization of pressure between the solvent make up container and the ink supply tank.

22. A solvent recovery system as set forth in claim 21 and wherein said equalizing conduit includes first and second portions and a manifold, said conduit first portion connecting the solvent make up container airspace to the manifold and said conduit second portion connecting the manifold to the ink supply tank.

23. A solvent recovery system as set forth in claim 21 and wherein the solvent make up container is sealed such that solvent vapor in the container is not vented to the atmosphere.

24. A solvent recovery system as set forth in claim 23 and further including a solvent supply device for supplying solvent to the solvent make up container, said solvent supply device including a solvent supply container for containing solvent, said solvent supply container including an airspace, said solvent supply device including a supporting device for supporting said solvent supply container and a first conduit connecting the solvent supply container to the solvent make up container such that solvent can be supplied to the solvent make up container without venting the solvent make up container to the atmosphere.

25. A solvent recovery system as set forth in claim 24 and wherein said solvent supply device further includes a second conduit connecting the solvent make up container airspace to the solvent supply container airspace to vent the solvent make up container airspace to the solvent supply container, and the support device supports the solvent supply container for tipping movement from a first position where the solvent supply container is substantially upright and a second position where the solvent supply container is substantially inverted, wherein in the second position the solvent supply container supplies solvent through the first conduit to the solvent make up container and the second conduit vents the airspace of the solvent make up container to the solvent supply container.

26. A solvent recovery system as set forth in claim 21 and further including an ink make up container connected to the ink supply tank for supplying ink to the ink supply tank, said ink make up container including an airspace;

an equalizing conduit connecting the ink make up container airspace to one of the ink supply tank airspace and the tube to provide equalization of pressure between the ink make up container and the ink supply tank.

27. A solvent recovery device as set forth in claim 26 and wherein the solvent make up container is sealed such that solvent vapor in the container is not vented to the atmosphere.

28. A solvent recovery system as set forth in claim 26 and wherein the ink make up container is sealed such that solvent vapor in the container is not vented to the atmosphere.

29. A solvent recovery system as set forth in claim 28 and further including an ink supply device for supplying ink to the ink make up container, said ink supply device including an ink supply container for containing ink, said ink supply container including an airspace, said ink supply device including a supporting device for supporting said ink supply container and a first conduit connecting the ink supply container to the ink make up container such that ink is supplied to the ink make up container without venting the ink make up container to the atmosphere.

30. A solvent recovery system as set forth in claim 29 and wherein said ink supply device further includes a second conduit connecting the ink make up container airspace to the ink supply container airspace to vent the ink make up container airspace to the ink supply container, and the support device supports the ink supply container for tipping movement from a first position where the ink supply container is substantially upright and a second position where the ink supply container is substantially inverted, wherein in the second position the ink supply container supplies ink through the first conduit to the ink make up container and the second conduit vents the airspace of the ink make up container to the ink supply container.

31. An ink supply system, for ink jet printers, the ink supply system comprising:

an ink supply tank for containing ink and solvent, the tank being connectable to an ink jet printer, the tank being a closed container and including an airspace having evaporated solvent therein;

a solvent make up container connected to the ink supply tank for supplying solvent to the ink supply tank, said solvent make up container including an airspace; and an equalizing conduit connecting the solvent make up container airspace to the ink supply tank airspace to provide for equalization of pressure between the solvent make up container and the ink supply tank.

32. An ink supply system as set forth in claim 31 and wherein said equalizing conduit includes first and second portions and a manifold, said conduit first portion connecting the solvent make up container airspace to the manifold and said conduit second portion connecting the manifold to the ink supply tank.

33. An ink supply system as set forth in claim 31 and wherein the solvent make up container is sealed such that solvent vapor in the container is not vented to the atmosphere.

34. An ink supply system as set forth in claim 33 and further including a solvent supply device for supplying solvent to the solvent make up container, said solvent supply device including a solvent supply container for containing solvent, said solvent supply container including an airspace, said solvent supply device including a supporting device for supporting said solvent supply container and a first conduit connecting the solvent supply container to the solvent make up container such that solvent can be supplied to the solvent make up container from the solvent supply container without venting the solvent make up container to the atmosphere.

35. An ink supply system as set forth in claim 34 and wherein said solvent supply device further includes a second conduit connecting the solvent make up container airspace to the solvent supply container airspace to vent the solvent make up container airspace to the solvent supply container, and the supporting device supports the solvent supply container for tipping movement from a first position where the solvent supply container is substantially upright and a second position where the solvent supply container is substantially inverted, wherein in the second position the solvent supply container supplies solvent through the first conduit to the solvent make up container and the second conduit vents the airspace of the solvent make up container to the solvent supply container.

36. An ink supply system as set forth in claim 31 and further including an ink make up container connected to the ink supply tank for supplying ink to the ink supply tank, said ink make up container including an airspace;

an equalizing conduit connecting the ink make up container airspace to the ink supply tank airspace to provide for equalization of pressure between the ink make up container and the ink supply tank.

37. An ink supply system as set forth in claim 36 and wherein said ink make up container is sealed such that solvent vapor in the container is not vented to the atmosphere.

38. An ink supply system as set forth in claim 36 and wherein the ink make up container is sealed such that solvent vapor in the container is not vented to the atmosphere.

39. An ink supply system as set forth in claim 38 and further including an ink supply device for supplying ink to the ink make up container, said ink supply device including an ink supply container for containing ink, said ink supply container including an airspace, said ink supply device including a supporting device for supporting said ink supply container and a first conduit connecting the ink supply container to the ink make up container such that ink can be supplied to the ink make up container from the ink supply container without venting the ink make up container to the atmosphere.

40. An ink supply system as set forth in claim 39 and wherein said ink supply device further includes a second conduit connecting the ink make up container airspace to the ink supply container airspace to vent the airspace of the ink make up container to the ink supply container, and the supporting device supports the ink supply container for tipping movement from a first position where the ink supply container is substantially upright and a second position where the ink supply container is substantially inverted, wherein in the second position the ink supply container supplies ink through the first conduit to the ink make up container and the second conduit vents the airspace of the ink make up container to the ink supply container.

* * * * *